United States Patent [19]

Haikkala

[11] 4,274,600

[45] Jun. 23, 1981

[54] METHOD OF AND A GRINDER FOR GRINDING WOOD UNDER PRESSURE

[75] Inventor: Pekka O. Haikkala, Tampere, Finland

[73] Assignee: OY. Tampella AB, Tampere, Finland

[21] Appl. No.: 6,156

[22] Filed: Jan. 24, 1979

[30] Foreign Application Priority Data

Feb. 16, 1978 [FI] Finland ..... 780514

[51] Int. Cl.[3] ..... B02C 23/24

[52] U.S. Cl. ..... 241/18; 241/28; 241/281; 241/DIG. 14

[58] Field of Search ..... 241/DIG.14, 18, 28, 241/152 A, 220, 221, 222, 280, 281

[56] References Cited

U.S. PATENT DOCUMENTS

| | | | |
|---|---|---|---|
| 1,099,557 | 6/1914 | Lorenz et al. | 241/DIG. 14 |
| 1,713,510 | 5/1929 | Briner | 241/18 |
| 3,808,090 | 4/1974 | Logan et al. | 241/28 X |
| 3,948,449 | 4/1976 | Logan et al. | 241/28 X |

*Primary Examiner*—Richard B. Lazarus
*Attorney, Agent, or Firm*—Ladas & Parry

[57] ABSTRACT

A method of grinding wood under pressurized conditions in a grinder according to which wood is fed in batches into a pressurized gas-filled grinding chamber provided with a rotary grinding means. The wood batches are fed through a feeding chamber provided with means for sequentially opening and pressure-tightly closing said feeding chamber from two sides in and respectively out of communication with the atmosphere and said grinding chamber respectively. The groundwood stock is discharged from the grinding chamber through a pressure lock formed by the groundwood stock. In this way feeding of the wood batches into the grinding chamber and the discharging of the groundwood stock out from said grinding chamber are carried out as sluicing steps, whereby a continuous pressure can be maintained in the grinding chamber in spite of feeding of new wood batches and discharging of groundwood stock.

3 Claims, 1 Drawing Figure

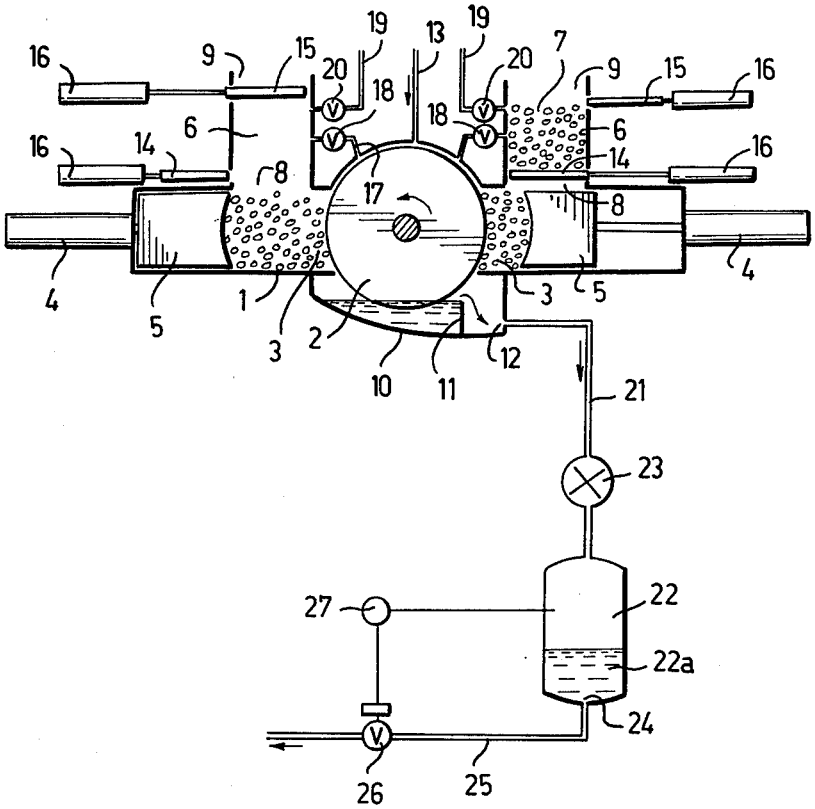
16
9
15
19
13
19
7
9
15
16
20
18
20
18
6
16
14
6
14
16
8
17
8
4
5
1
3
2
10
11
12
3
5
4
21
23
27
22
22a
24
26
25

METHOD OF AND A GRINDER FOR GRINDING WOOD UNDER PRESSURE

The present invention relates to a method of grinding wood under pressurized conditions in a grinder comprising a pressurized gas-filled grinding chamber for a rotating grinding means, according to which method wood is fed in batches into said grinding chamber, the fed wood batch is pressed against said grinding means and the formed groundwood stock is discharged from said grinding chamber.

It is well known to grind wood in batches by pressing a wood batch by means of a pressing element against a rotating grinding stone while simultaneously feeding shower water into the grinding chamber. By means of a dam the formed groundwood stock level is kept in the grinding chamber a little higher than the lower surface of the stone in order to clean, lubricate and cool the stone. The groundwood stock flowing over the dam has been discharged by its own weight from the grinding chamber for further treatment.

It is also known, for example from U.S. Pat. Nos. 3,808,090 and 3,948,449 that the groundwood can be improved by grinding wood in a closed grinding chamber in a pressurized gaseous atmosphere. The gas consists of air, steam or an inert gas, and the overpressure of the gas may rise up to about 1.4–2.8 bar. In the grinder described in said patents wood is fed batchwise and the pressurized gaseous atmosphere of the grinding chamber can be maintained only as long as the grinding of a wood batch continues but as soon as a new wood batch is fed into the magazine the pressure in the grinding becomes atmospheric. Thus the grinder cannot work with a continuously pressurized atmosphere in the grinding chamber.

Because the material to be fed into the grinder consists of blocks of wood, it is not possible to use any rotary valves of corresponding pressure preserving feeding devices which are generally used when feeding e.g. wood chips into pressurized digesters, disc refiners or the like. Therefore difficulties have arisen when trying to feed wood into the grinding chamber and to discharge the groundwood stock from the grinding chamber without allowing the pressure in the grinding chamber to drop.

The object of the present invention is to obtain a method which eliminates said disadvantages and makes possible both feeding of wood and discharging of groundwood stock without harmfully effecting the pressurized gaseous atmosphere in the grinding chamber. This object is achieved by means of a method according to the invention, wherein the batches of wood are fed into the pressurized gas-filled grinding chamber through a feeding chamber, which can be sequentially opened and closed pressure-tightly from two sides in communication with the atmosphere and said grinding chamber respectively, and wherein the groundwood stock is discharged from the pressurized gas-filled grinding chamber through a pressure lock formed by the groundwood stock.

The invention is based on the idea that the feeding of the wood batch into the grinding chamber and the discharge of the groundwood stock out from said chamber are carried out as sluicing steps, whereby for feeding of the wood batch is used as sluice provided with mechanical, pressure preserving means and for discharging is used a sluice, in which the groundwood stock itself serves as a lock which maintains the pressurized atmosphere in the grinding chamber.

The invention relates also to a grinder for carrying out the above mentioned method and this grinder is mainly characterized in that the feeding device comprises a stationary feeding chamber, which can be sequentially pressure-tightly closed from the atmosphere and from the grinding chamber respectively by shutters, and that the discharging device comprises a tank for the groundwood stock which forms a pressure lock between the grinding chamber and the atmosphere.

In the following the invention will be described in more detail with reference to the enclosed drawing which is a diagrammatic view of an embodiment of a grinder according to the invention.

The grinder shown in the drawing comprises a frame 1 and a grinding stone 2 which is rotatably mounted in the frame. On both sides of the grinding stone there is a pressure-tight grinding chamber 3. In each grinding chamber a pressure shoe 5 is provided which is displaceable by means of a hydraulic cylinder 4. Above each grinding chamber a vertical feeding chamber 6 is provided for a wood batch 7 to be fed into the grinding chamber. The feeding chamber has a lower opening 8 communicating with the grinding chamber and an upper opening 9 communicating with the atmosphere. Below the grinding stone the frame forms a pit 10 which is provided with an overflow 11 and an outflow 12. Shower water is fed on the grinding stone by nozzles which are not shown. A grinder of the type described above is known per se, and therefore it will not be further described. The grinder is further provided with a feed pipe 13 for pressurized gas in orer to subject the grinding chambers to an adjustable pressure.

According to the invention, the lower and upper openings of each feeding chamber is pressure-tightly sealed by means of parallel shutters 14,15 which are displaced by hydraulic cylinders 16. Thus the feeding chamber and the shutters form a pressure-tight sluice. The feeding chamber is connected to the grinding chamber through a pipe 17 which can be closed or opened by means of a valve 18, and to the atmosphere through a pipe 19 which can be closed or opened by means of a valve 20.

According to the invention the outflow 12 of the grinder is connected through a pipe 21 to a pressure-tight tank 22. Said pipe 21 is provided with a stick crusher positioned between the grinding chamber 3 and a control valve 26, in this case between the grinding chamber and the tank 22. At the bottom of the tank there is an outflow 24 which is connected to an outflow pipe 25 which can be closed and opened by means of a valve 26. The operation of the valve is controlled by means of a pressure difference detector 27, which detects the height of the groundwood stock in the tank.

The grinder operates as follows:

A wood batch is pressed by the pressure shoe 5 against the grinding stone in the right-hand grinding chamber of the grinder. A new wood batch has been brought into the feeding chamber 6, whereby the lower shutter 14 of the chamber is pressure-tightly closed and the upper shutter 15 is open. The valve 18 in the pipe to the grinding chamber is closed. The same applies to the valve 20 to the atmosphere. When the feeding chamber is filled the upper shutter is pressure-tightly closed. Thereafter the valve 18 in the pipe to the grinding chamber is opened so that the pressure in the feeding chamber becomes the same as the pressure in the grinding chamber. When the wood batch in the grinding chamber has been ground and the pressure shoe has been displaced to its receiving position the lower shutter 14 is opened so that the new wood batch falls from the feeding chamber into the grinding chamber as shown in the left-hand part of the grinder. Thereafter the lower shutter 14 and the valve 18 are closed and the valve 20 to the atomosphere is opened, whereby the pressure in the feeding chamber becomes atmospheric. The upper shutter 15 can now be opened and a new wood batch can be brought into the feeding chamber.

When a wood batch is fed from the feeding chamber into the grinding chamber, also relatively cold air flows into the grinding chamber at the same time. The temperature in the grinding chamber is generally kept above 100° C. and therefore the cold air flowing into the grinding chamber expands and thereby increases the pressure in the grinding chamber. Excessive air can be discharged from the grinding chamber by means of a pressure-balancing valve (not shown) in order to keep the pressure in the grinding chamber at a desired level. Also pressure drops in the grinding chamber caused by leakage can thus be compensated by the pressurized air flowing in from the feeding chamber.

It is observed that the above-described feeding system makes it possible to feed wood into a grinding chamber in which there is a continuous pressurized atmosphere and to maintain the desired overpressure in the grinding chamber at the same time.

The groundwood stock is collected in the pit 10 of the grinder and forms in the pit a damm of groundwood stock with a consistency of 0.8–4%. This stock generally contains sticks, chips and pieces of wood which have passed the grinding process. The surface of the damm is about 2–10 cm higher than the lower surface of the grinding stone. The suspension flows over the overflow 11 and by its own weight further to the stick crusher 23 in which the sticks, chips and pieces of wood which passed the grinding process are crushed into smaller pieces in order to prevent choking of the valve 26. From the crusher the groundwood stock flows into the tank 22, the interior of which is under the same pressure as the grinding chambers, for example 0.8–3.0 bar. This pressure tends to force the groundwood stock from the tank through the outlet pipe 25 but the outflow of stock is controlled by the valve 26 and the pressure difference detector 27 so that the surface of the groundwood stock 22*a* in the tank is always at a preset level above the outlet of the tank. This layer in the tank prevents the pressure from disappearing from the grinding chamber.

It is observed that the described discharge system makes it possible to discharge groundwood stock from a pressurized grinding chamber to atmospheric pressure and to maintain the desired overpressure in the grinding chamber at the same time. Together with the earlier described feeding system it is possible to obtain a continuously working pressure grinder.

The object of the drawing and the description is only to illustrate the idea of the invention. In details the method and the grinder for carrying out the method can vary considerably within the scope of the claims.

What I claim is:

1. A method of grinding wood under pressurized conditions in a gas-filled grinding chamber, comprising the steps of (a) feeding a batch of wood to be ground into a feeding chamber by way of an input opening thereof, said feeding chamber having an output opening which leads into said grinding chamber and is closed in pressure-tight manner;

(b) closing the input opening of the feeding chamber in pressure-tight manner;

(c) opening the output opening of the feeding chamber;

(d) passing said batch of wood from the feeding chamber into the grinding chamber by way of said output opening;

(e) closing said output opening in pressure-tight manner;

(f) substantially continuously grinding said batch of wood under pressurized conditions in the grinding chamber to form a primary groundwood stock and, while so doing, opening said input opening, repeating steps (a) and (b) and discharging primary groundwood stock from the grinding chamber;

(g) repeating steps (c), (d) and (e) while discharging primary groundwood stock from the grinding chamber;

(h) repeating step (f);

(i) passing the primary groundwood stock discharged from the grinding chamber to a stick crusher while maintaining the stock under superatmospheric pressure;

(j) employing the stick crusher to crush sticks present in the primary groundwood stock, while maintaining the stock under superatmospheric pressure, thereby to produce a secondary groundwood stock under superatmospheric pressure;

(k) passing the secondary groundwood stock to a valve having an outlet to atmospheric pressure while maintaining the stock under superatmospheric pressure; and (l) continuously discharging secondary groundwood stock to atmospheric pressure through the valve outlet while preserving a hydraulic seal of secondary groundwood stock upstream of said valve.

2. A method according to claim 1, comprising the step, between steps (b) and (c), of adjusting the pressure in the feeding chamber to correspond to the pressure in the grinding chamber and further comprising the step, after step (e) and before opening said input opening, of adjusting the pressure in the feeding chamber to correspond to atmospheric pressure.

3. A method according to claim 1 or 2, comprising the step of adjusting the rate of discharge of groundwood stock through the valve so as to maintain the level of secondary groundwood stock upstream of said valve at a preset level.

* * * * *

UNITED STATES PATENT AND TRADEMARK OFFICE

CERTIFICATE OF CORRECTION

PATENT NO. : 4,274,600

DATED : June 23, 1981

INVENTOR(S) : Pekka Olavi Haikkala

It is certified that error appears in the above-identified patent and that said Letters Patent is hereby corrected as shown below:

On the Title Page insert:

The term of this patent subsequent to June 2, 1998, has been disclaimed.

Signed and Sealed this

Twenty-eighth Day of October, 1986

[SEAL]

*Attest:*

DONALD J. QUIGG

*Attesting Officer* *Commissioner of Patents and Trademarks*